United States Patent [19]

Simpson

[11] Patent Number: 4,595,086

[45] Date of Patent: Jun. 17, 1986

[54] PORTABLE DESK-WORK BENCH WITH CARRYING CASE

[76] Inventor: Lewis H. Simpson, c/o L.H.S. Enterprises, 949 Grant St. - Box 5, Benicia, Calif. 94510

[21] Appl. No.: 615,804

[22] Filed: May 31, 1984

[51] Int. Cl.[4] ..... A47B 3/10

[52] U.S. Cl. ..... 190/11; 190/12 A; 190/100; 108/43; 108/129

[58] Field of Search ..... 190/1, 9, 11, 12 R, 190/12 A, 100, 107; 206/45.2, 45.23; 108/33, 35, 36, 43, 129; 312/235 A, 330 R, DIG. 33

[56] References Cited

U.S. PATENT DOCUMENTS

| | | | |
|---|---|---|---|
| 2,277,435 | 3/1942 | Howe | 190/11 |
| 2,522,322 | 9/1950 | Wallace | 190/11 |
| 2,609,072 | 9/1952 | Levinson | 190/11 |
| 2,739,863 | 3/1956 | Ferris | 312/DIG. 33 |
| 3,396,928 | 8/1968 | Lay | 108/129 |
| 3,741,430 | 6/1973 | Bergh et al. | 206/45.23 |
| 3,783,999 | 1/1974 | Smith | 206/45.23 |
| 4,049,091 | 9/1977 | Chubb | 190/102 |
| 4,404,915 | 9/1983 | Simpson | 108/43 |

FOREIGN PATENT DOCUMENTS

| | | | |
|---|---|---|---|
| 15876 | of 1904 | United Kingdom | 190/12 R |

*Primary Examiner*—Joseph Man-Fu Moy
*Assistant Examiner*—David Fidei
*Attorney, Agent, or Firm*—Harvey B. Jacobson

[57] ABSTRACT

A top unit is provided defining a upper work surface and having front, rear and opposite side marginal portions. A downwardly opening cover also having front, rear and opposite side marginal portions is provided and the rear marginal portion of the cover is pivotally supported from the rear marginal portion of the top unit for swinging about an axis generally paralleling the rear marginal portions between a closed position closely telescopingly engaged over the top unit from above and a open position extending upwardly from the rear marginal portion of the top unit. Also, the cover is supported for shifting of the cover, after it has been swung to the open position, relative to the axis of rotation of the cover relative to the top unit, along a path extending between the front and rear marginal portions of the cover to a position with the axis closely adjacent the front marginal portion of the cover and the cover disposed at generally right angles relative to the top unit, having its front marginal portion disposed to the rear of the top unit rear marginal portion and the rear marginal portion of the top unit lowermost. Short and long front and rear leg assemblies are stored within downwardly opening center and opposite side compartments defined by the top unit and the latter includes a bottom panel hingedly supported from the lower rear marginal portion thereof for swinging between a depending open position and a closed position closing the compartments from below.

8 Claims, 17 Drawing Figures

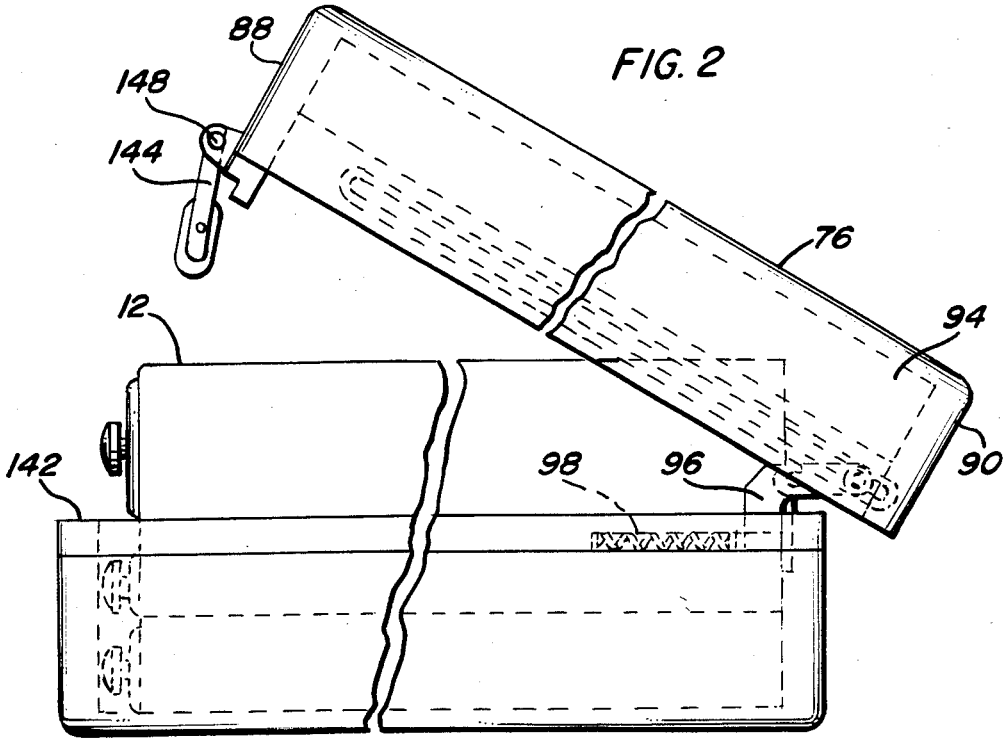
FIG. 2
FIG. 3
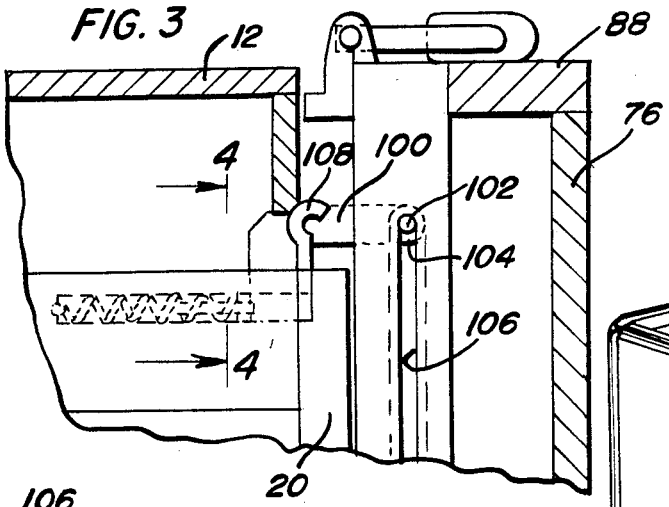
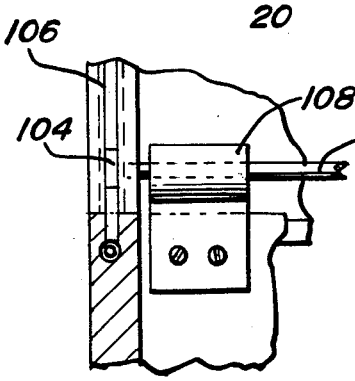
FIG. 4
FIG. 1
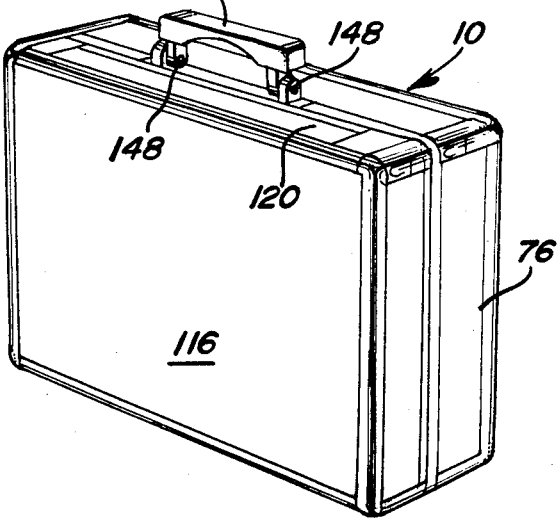

PORTABLE DESK-WORK BENCH WITH CARRYING CASE

BACKGROUND OF THE INVENTION

Various forms of portable desks, podiums and legged carrying cases heretofore have been provided such as the Portable Desk-Work Bench disclosed in my prior U.S. Pat. No. 4,404,915, dated Sept. 20, 1983. However, previously known structures, for the most part, are not fully collapsible into a completely closed carrying case and do not include openable drawers completely hidden from view when the drawers are closed and the case itself is fully closed. Accordingly, a need exists for an improved form of portable desk, work table and carrying case combination.

BRIEF DESCRIPTION OF THE INVENTION

The portable desk, work table and carrying case combination of the instant invention includes a top unit including forwardly openable upper and lower drawers and a downwardly opening cover pivotally supported at its rear marginal edge from the rear marginal edge of the top unit for swinging between a closed position telescoped over the upper portion of the top unit preventing the upper drawer from being opened and an open position with the cover projecting upwardly from the rear marginal edge of the top unit. Further, the cover is also supported for movement, when the cover is in the open position, vertically downward relative to the top unit with the forward marginal edge of the cover disposed immediately rearwardly of the rear marginal edge of the top unit and the rear marginal edge of the cover projecting downwardly and the lower rear marginal portion of the top unit. Also, the top unit defines central and opposite side front to rear extending downwardly opening compartments in which central and opposite side legs are stored in collapsed positions and from which the legs may depend substantially vertically downwardly in operative positions for support of the combination from upwardly facing support surfaces with which the lower ends of the legs are engaged. The combination further includes a bottom panel hingedly supported at its rear marginal edge from the lower rear marginal edge of the top unit and swingable between a closed position closing said compartments from below and an open position depending downwardly from the lower rear marginal portion of the top unit closely forward of the depending cover. The bottom panel includes a closure panel swingably supported from the free swinging edge thereof and the closure panel is swingable into closed position closely forward of lower drawers of the top unit when the bottom panel is in the closed position thereby preventing the lower drawers from opening. The assembly, when the bottom panel, closure panel and cover are in the closed positions thereof, is completely closed and has the appearance of a substantially conventional carrying case, the forward marginal portion of the top unit including a pivoted carrying handle.

The main object of this invention is to provide a combined desk, work table and carrying case which may be opened to provide access to not only an upper working surface but also to expose multiple forwardly slidable drawers and which further may include a single central front leg and a pair of opposite side rear legs, the front leg being short and engageable with the forward marginal portion of a chair seat upon which the user of the combination is seated and the front legs being long for engagement with the floor surface upon which the seat occupied by the user is disposed.

Another object of this invention is to provide an apparatus in accordance with the preceding object and wherein various readily accessible latch structure are provided for retaining the cover and the closure panel, and thus the bottom panel, in the closed positions.

A final object of this invention to be specifically enumerated herein is to provide a combined desk, work table and carrying case in accordance with the preceding objects and which conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of the desk, work table and carrying case combination in the fully closed position;

FIG. 2 is a side elevational view of the carrying case with portions thereof being broken away and with the downwardly opening cover thereof in a partially open position;

FIG. 3 is an enlarged fragmentary vertical sectional view illustrating the rear upper marginal portion of the top unit of the invention and with the cover in a fully open and downwardly displaced out-of-the-way position;

FIG. 4 is an enlarged fragmentary vertical sectional view taken substantially upon the plane indicated by the section line 4—4 of FIG. 3;

DETAILED DESCRIPTION OF THE INVENTION

Figure 7:
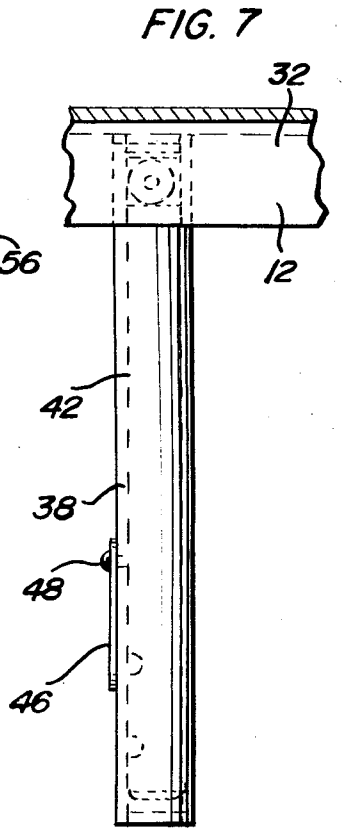
FIG. 7 is a fragmentary vertical sectional view illustrating the short central front leg in a depending position.
Figure 5:
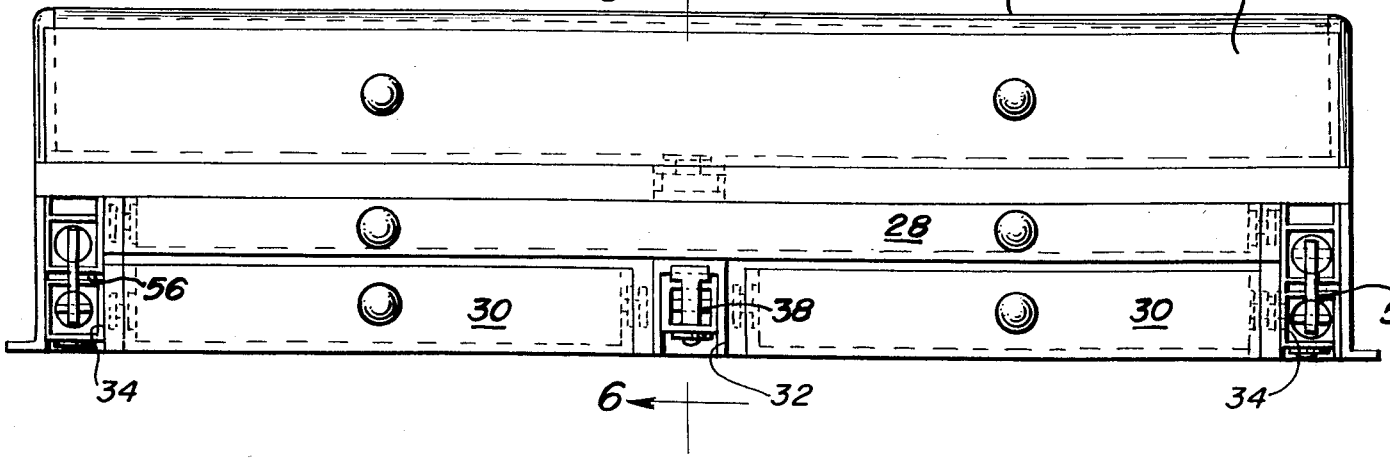
FIG. 5 is an enlarged front elevational view of the case with the case and bottom panel removed.
Figure 6:
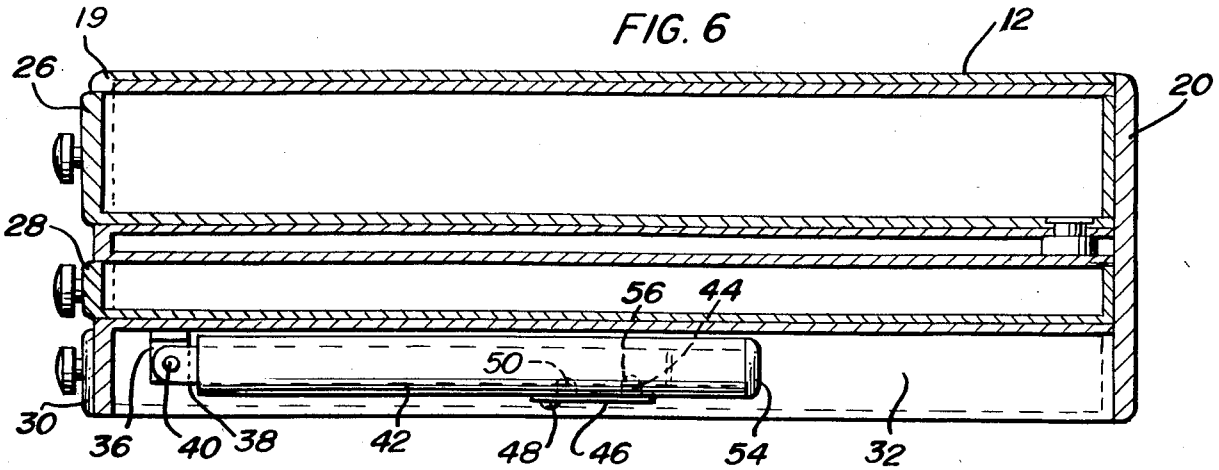
FIG. 6 is a transverse vertical sectional view taken substantially upon the plane indicated by the section line 6—6 of FIG. 5.
Figure 8:
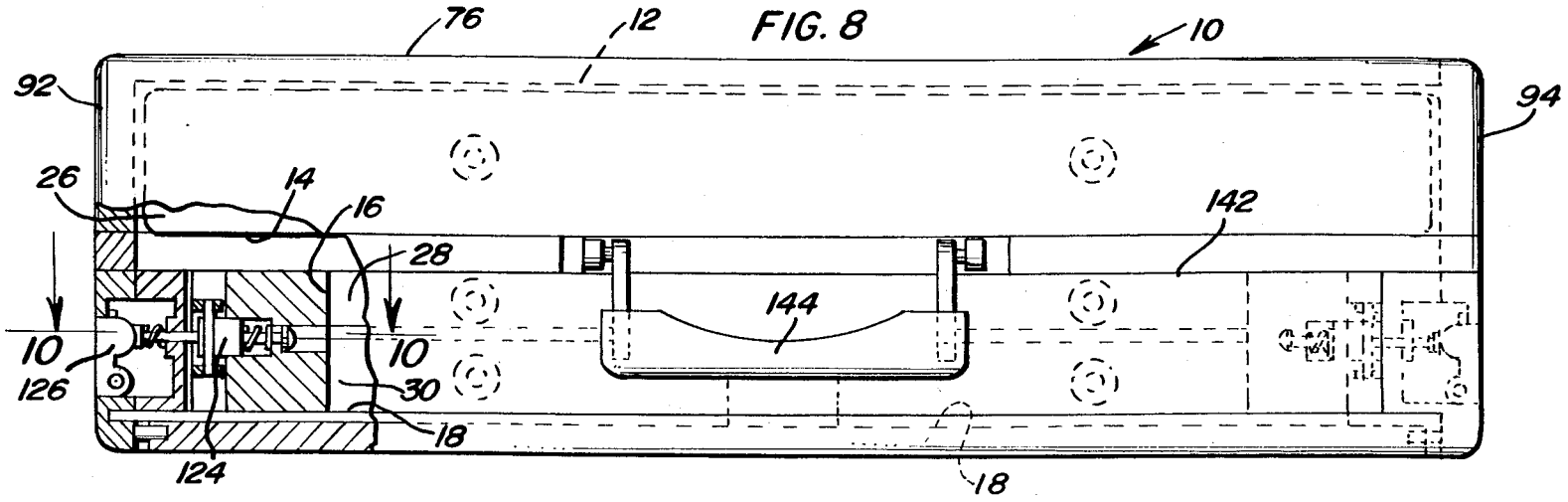
FIG. 8 is a front elevational view of the invention with a portion of the forward left side thereof being broken away and illustrated in vertical section.
Figure 10:
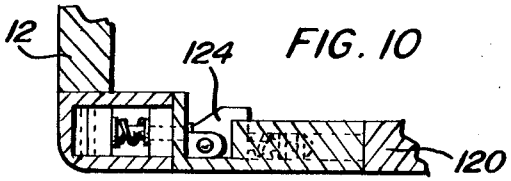
FIG. 10 is a fragmentary horizontal sectional view taken substantially upon the plane indicated by the section line 10—10 of FIG. 8.

Referring now more specifically to FIGS. 1,5,6 and 8 of the drawings, the numeral 10 generally designates the portable desk, work table and carrying case combination of the instant invention. The combination 10 includes a top unit 12 in the form of a hollow housing defining an upper substantially full width forwardly open drawer compartment 14, a reduced width and forwardly opening intermediate drawer compartment 16 and a pair of lower laterally spaced apart drawer compartments 18. The top unit includes a front marginal portion 19, a rear marginal portion 20 and opposite side marginal portions 22 and 24. The compartments 16 and 18 are spaced inwardly of the marginal portions 22 and 24 and the compartments 14 and 16 have forwardly openable upper and lower drawers 26 and 28 disposed therein, thereas the compartments 18 include forwardly openable drawers 30 therein.

Figure 12:
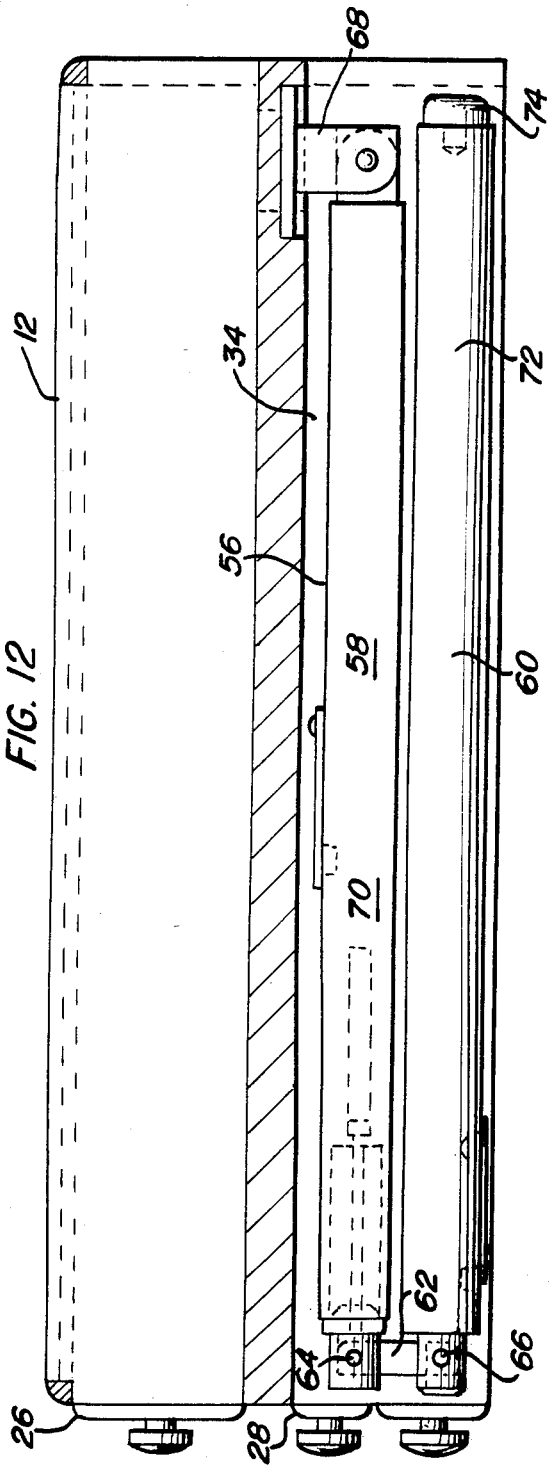
FIG. 12 is a vertical sectional view taken substantially upon the plane indicated by the section line 12—12 of FIG. 11.

That portion of the top or drawer unit disposed between the drawers 30 defines a downwardly opening front leg cavity 32 and those portions of the unit 12 disposed at remote sides of the drawers 28 and 30 define downwardly opening rear leg cavities 34, see FIG. 12. The front leg cavity 32 has a mounting bracket 36 mounted in the forward end thereof to which the upper end of a downwardly swingable short front leg 38 is pivotally mounted as at 40. The front leg 38 includes an outer sleeve 42 slidably telescoped thereover and includes a detent member 44 mounted on the free end of a leaf spring 46 anchored to the sleeve 42 as at 48. The leg 38 includes first and second longitudinally spaced openings 50 and 52 formed therein in which the detent member 44 may be received. When the detent member 44 is received in the opening 50, the sleeve 42 is telescoped away from the pivotal connection at 40. However, when the leg 38 has its free end swung downwardly to an operative position, the detent member 44 is laterally outwardly retracted from the opening 50, the sleeve 42 is shifted upwardly along the leg 38 and telescopingly engaged over the pivot connection at 40 and held in upwardly shifted position by engagement of the detent member 44 and the opening 52. When the sleeve 42 is in the upwardly displaced position, the upper end of the sleeve 42 telescopingly receives the pivot connection as at 40 therein and thereby retains the leg 38 in the downwardly extending operative position. The lower or free end of the sleeve 42 includes a foot member supported therefrom for engagement with the central portion of the forward marginal edge of a chair seat portion.

Figure 11:
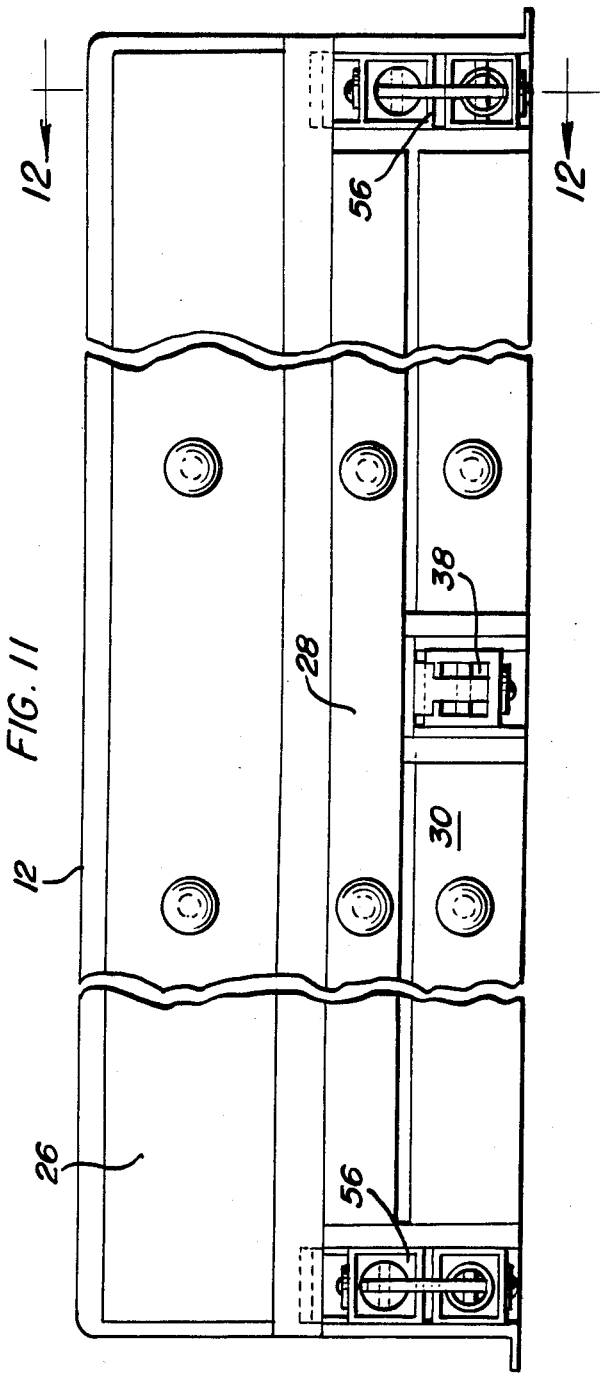
FIG. 11 is a fragmentary front elevational view of the invention with the cover and bottom panel removed.

Each of the cavities 34 receives a long rear leg 56 therein, see FIG. 11 including a pair of upper and lower leg members 58 and 60, see FIG. 12 pivotally joined together by a connecting bar 62 extending between and pivotally joined to the leg members 58 and 60 as at 64 and 66. Each upper leg member 58 is pivotally mounted within the corresponding cavity 34 by a bracket 68 corresponding to the bracket 36 and includes an outer sleeve 70 which functions in the same manner as the upper end of the sleeve 42. The leg member 60 includes an outer sleeve 72 which is longitudinally shiftable over the pivot structure 62, 64 and 66 pivotally interconnecting the leg members 58 and 60 in order to retain the leg members 58 and 60 in longitudinally aligned positions. Also, the free end of the sleeve 72 includes a foot member 74 corresponding to the foot member 54.

The rear legs 56 are considerably longer than the front leg 38 and are adapted to extend downwardly from the top unit or housing 12 for engagement with an upwardly facing floor surface upon which a chair with whose forward seat portions the leg 38 is engaged is supported.

The upper portion of the top unit or housing 12 includes a downwardly opening cover 76, see FIG. 2, including a front marginal portion 88, a rear marginal portion 90 and opposite side marginal portions 92 and 94. A pair of front-to-rear shiftable mounting brackets 96 are supported from the rear portions of the opposite side marginal portions 92 and 94 for shifting between front and rear limit positions and are spring biased, by compression springs 98 toward their rearmost limit positions. The brackets 96 include rearwardly projecting arm portions 100, see FIG. 3 whose rear ends support opposite end portions of a cross shaft 102 extending therebetween and having rollers 104 journalled thereon. The rollers 104 are guidingly received in slotted brackets 106 supported from and extending along the marginal portions 92 and 94. In addition, the rear ends of the marginal portions 92 and 94 include abutment brackets 108 see FIGS. 3 and 4 supported therefrom against which the end portions of the cross shaft 102 are abuttingly engageable when the brackets 96 are shifted toward their forward limit positions.

Figure 9:
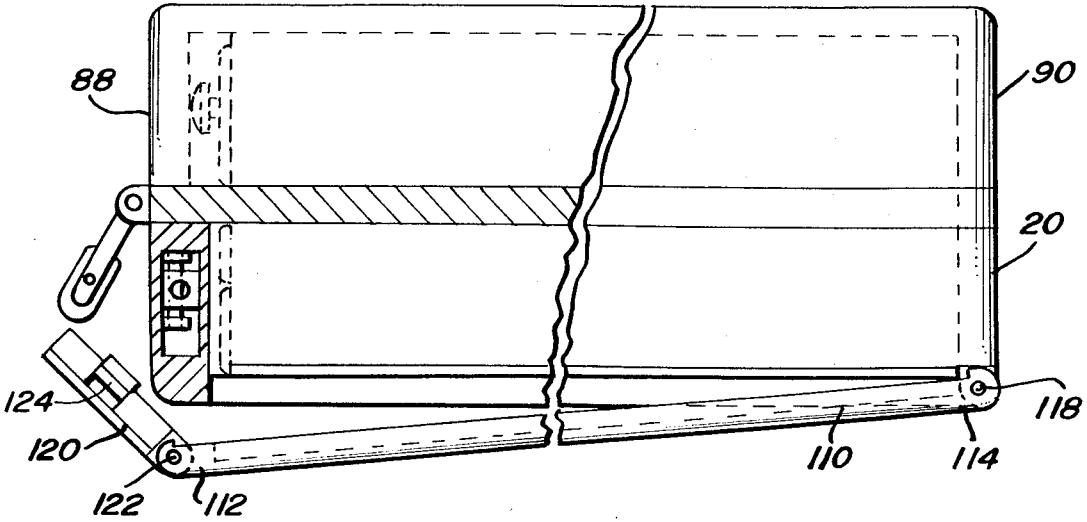
FIG. 9 is a fragmentary side elevational view of the case as seen from FIG. 8 and with the bottom panel and attached closure panel in a partially open position.
Figure 13:
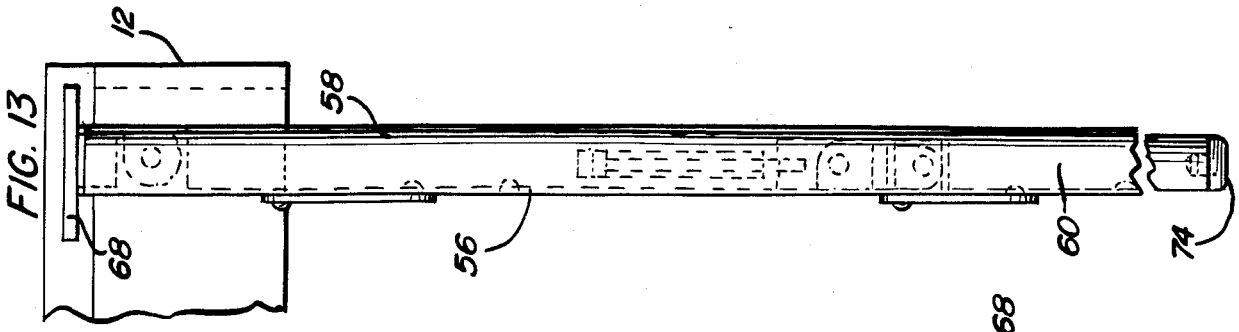
FIG. 13 is a fragmentary sectional view illustrating one of the opposite side depending legs in the fully extended position thereof.
Figure 16:
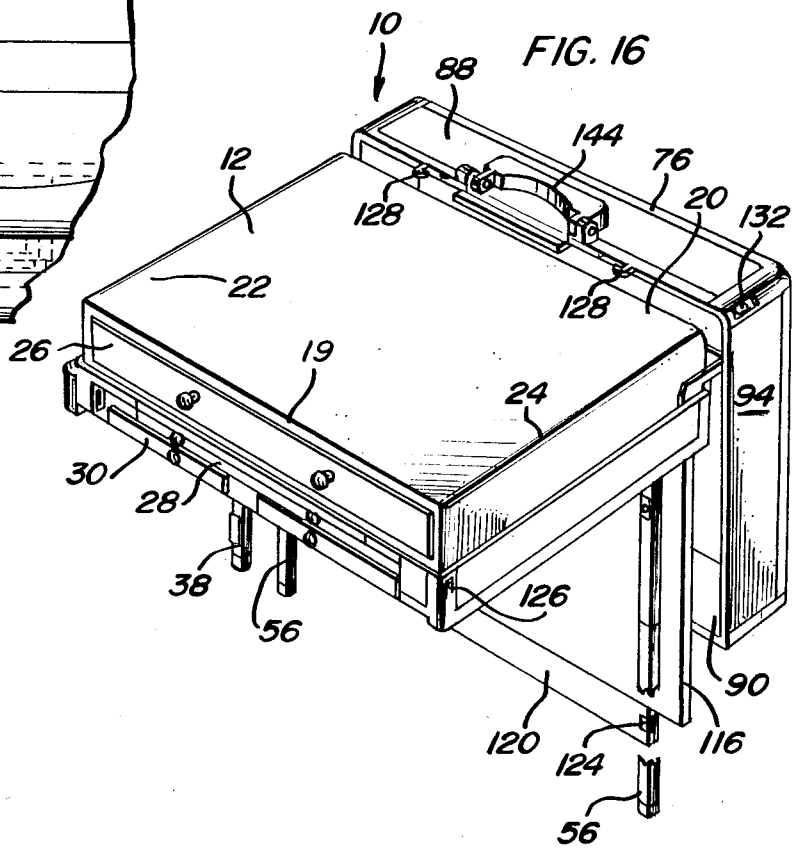
FIG. 16 is a reduced scale perspective view of the instant invention in the fully open position.

From a comparison of FIGS. 2, 9 and 16 of the drawings, it may be seen that the cover 76 may be swung upwardly from the fully closed position thereof illustrated in FIG. 9 through the partially open position thereof illustrated in FIG. 2 and thereafter shifted downwardly toward a position with the cover 76 vertically disposed and spaced slightly rearward of the rear marginal portion 20 of the top unit 12 and with the rear marginal portion 92 of the cover 76 lowermost and the front marginal portion 88 of the cover 76 uppermost and generally coextensive with the top unit 12.

From FIGS. 9 and 16 of the drawings, it may also be seen that the top unit 12 includes a bottom panel 110 having a front marginal portion 112, a rear marginal portion 114 and opposite side marginal portions 116 supported therefrom. The rear marginal portion 114 is pivotally supported from the lower portion of the rear marginal portion 20 as at 118 and the bottom panel 110 is swingable between a depending open position extending substantially vertically downward from the rear marginal portion 20 of the top unit 12 in the manner illustrated in FIG. 16 of the drawings to a closed position substantially flush with the undersurface of the top unit 12 and closing the lower ends of the cavities 32 and 34 and thereby serving to retain the legs 38 and 56 therein.

The forward marginal portion 112 of the bottom panel 110 includes a closure panel 120 pivotally supported therefrom as at 122. The closure panel 120, after the bottom panel 110 has been swung to the fully closed position, may be swung rearwardly and inwardly to a closed position closely opposing forward ends of the drawers 28 and 30 and in which closed position the closure panel 120 may be releasably shiftably supported from closure panel 120 and latched by spring biased latch assemblies 124 releasable upon inward displacement of spring returned latch release levers 126 pivotally mounted in forward lower corner portions of the top unit 12. Also, the opposite ends of the forward marginal portion 88 of the cover 76 includes spring biased pivotally mounted latching levers 128 see FIG. 14 hook engageable with front-to-rear extending keeper pins 130 mounted in the forward marginal portion 18 of the top unit 12 and releasable upon inward displacement of the lower ends of pivotally mounted spring returned latch releasing levers 132 mounted in the forward corner portions of the side marginal portions of the cover 76.

With attention invited more specifically to FIG. 1 of the drawing, it may be seen that the combination 10 has the appearance of a substantially conventional brief case when in the fully closed position. However, with attention now invited more specifically to FIG. 16, when the cover 76 is fully open, the bottom panel 110 is fully opened and the legs 38 and 56 are in their downwardly extended positions, the combination 10 may be used as a desk by a person seated on a chair and having the short front leg 38 bearing downward upon the central forward marginal edge of the seat of the chair between the user's legs and the lower ends of the legs 56 engaged with the floor surface upon which the chair is disposed.

The forward marginal portion 88 of the cover 76 maintains the upper drawer 22 in a closed position when the cover 76 is closed and the closure panel 120, when the bottom panel 110 is in the closed position and the closure panel 120 is in the closed position, maintains the drawers 28 and 30 in the closed positions. Further, when the bottom panel 110 is in the closed position, the legs 38 and 58 are maintained in their fully collapsed positions illustrated in FIGS. 6 and 12.

Figure 17:
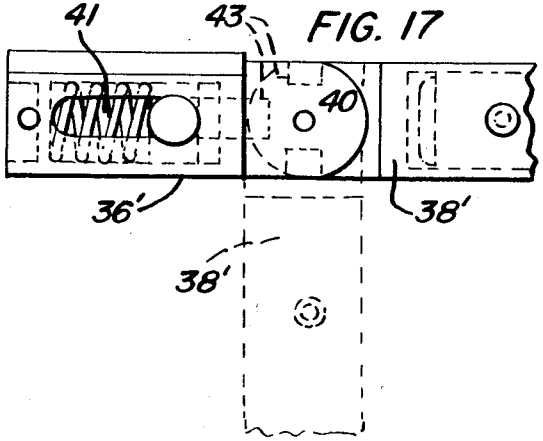
FIG. 17 is a fragmentary schematic view of a modified form of pivot and latching structure for attaching each of the legs to the top unit of the invention.

With attention now invited more specifically to FIG. 17 of the drawings, there may be seen a modified form of leg 38' which may be used in lieu of the leg 38. The leg 38' is pivotally mounted as at 40' from a mounting bracket 36' corresponding to the mounting bracket 36 and including a spring biased retractable detent 41 selectively engageable in suitable notches 43 formed in and spaced about the pivotally mounted end of the leg 38'. The engagement of the detent 41 in selected notches 43 may be used to maintain the leg 38' in either the horizontal retracted position or the downwardly depending operative position. Of course, when the detent and notch structure 41, 43 is used, there is no need to provide a sleeve such as the sleeve 42. Further, the detent and notch structure, 41, 43 may also be used to mount the base ends of the legs 56 within the cavities 34, if desired, and in such case there is no need to provide sleeves corresponding to the sleeves 70.

Figure 14:
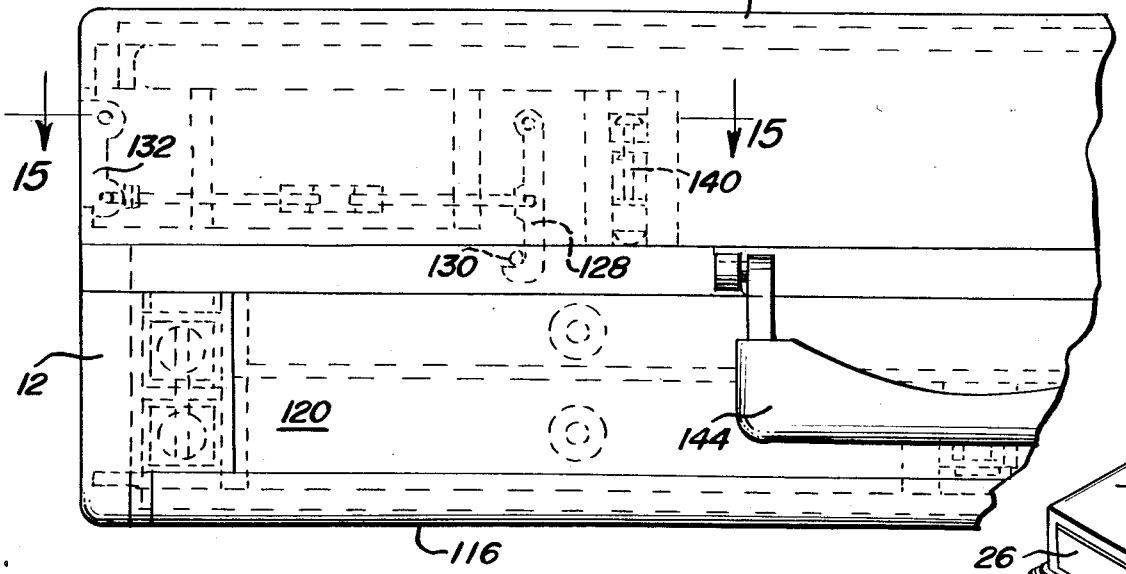
FIG. 14 is a fragmentary front elevational view of the invention with portions of the near walls thereof broken away in order to illustrate the cover latching structure.
Figure 15:
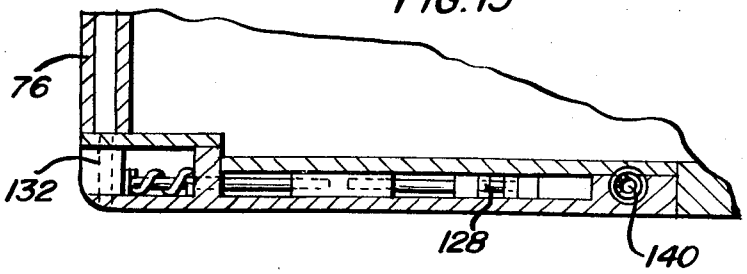
FIG. 15 is a fragmentary horizontal sectional view taken substantially upon the plane indicated by the section line 15—15 of FIG. 14.

The forward marginal portion 88 of the cover 76 includes a pair of spring biased plungers 140, see FIG. 14 which bear downwardly upon the upwardly facing forward marginal portion of the horizontally outwardly projecting shoulder 142 extending about the intermediate height portion of the top unit 12 and thereby serve to initially upwardly displace the forward marginal edge portion 88 of the cover 76 when the latch levers 128 are released from engagement with the shafts or pins 130. Further, the lower edges of the downwardly opening cover 76 closely oppose the shoulder 142, see FIG. 8 when the cover 76 is in the closed position and the lower central portion of the front marginal portion 88 of the cover 76 has a bale-type carrying handle 144 pivotally supported therefrom as at 148, whereby the combination 10 may be carried in the manner of a brief case when it is fully closed as illustrated in FIG. 1 of the drawings.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A portable desk, work table and carrying case combination including a top unit defining an upper work surface and having front, rear and opposite side marginal portions, a downwardly opening cover also having front, rear and opposite side marginal portions, support means hingedly supporting the rear marginal portion of said cover from the rear marginal portion of said top unit for swinging about an axis generally paralleling said rear marginal portions between a closed position closely overlying said top unit from above and an open position extending upwardly from said rear marginal portion, said support means also including means supporting said cover from said top unit for shifting of said cover, after it has been swung to said open position, relative to said axis and the top unit along a path extending between said front and rear marginal portions of said cover to a position with axis closely adjacent said front marginal portion of said cover and said cover dependingly disposed at generally right angles relative to said top unit, having its front marginal portion disposed to the rear of said top unit rear marginal portion and the rear marginal portion of said top unit lowermost, the portion of the top unit disposed below said abutment surfaces defining forwardly opening drawer compartment means, said drawer compartment means including a pair of laterally spaced apart forwardly opening opposite side lower drawer compartments, said top unit defining a center front-to-rear extending downwardly opening cavity between said opposite side lower drawer components and a pair of opposite side front-to-rear extending downwardly opening cavities between remote sides of said lower drawer compartments and said side marginal portions of said top unit, a pair of collasped side legs housed in said side compartments and a collapsed front center leg housed in said center compartment, said legs being extendible and positionable in depending operable positions extending downwardly from the respective compartments for support of said top unit in elevated position from upwardly facing surface portions from which the lower ends of said legs are supported.

2. The combination of claim 1 wherein said center leg comprises a front leg and said side legs comprise rear legs.

3. The combination of claim 2 wherein said center leg, when in its depending operative position, extends downwardly from said top unit a distance considerably less than a greater distance downwardly from said top unit said rear legs depend when said rear legs are in their operative positions.

4. The combination of claim 2 including a bottom panel having front, rear and opposite side marginal portions, means pivotally mounting said bottom panel rear marginal portion from a lower portion of said rear marginal portion of said top unit for swinging about an axis generally paralleling said rear marginal portions between an open position depending downwardly from said top unit rear marginal portion and a closed position closely underlying said top unit from below and closing center and said side compartments when said legs are collapsed therein.

5. The combination of claim 4 wherein said front marginal portion of said bottom panel includes front closure panel means hingedly supported therefrom and swingable, after said bottom panel has been swung to the closed position thereof, into a closed position closely opposing the forward extremities of said lower drawers and releasably latchable in closed position to prevent movement of said lower drawers from the closed positions thereof toward the open positions thereof.

6. The combination of claim 5 wherein said cover, when in the depending position at generally right angles relative to said top unit, extends downwardly behind said bottom panel when the latter is in the open position thereof.

7. A portable desk, work table and carrying case combination including a top unit defining an upper work surface and having front, rear and opposite side marginal portions, a downwardly opening cover also having front, rear and opposite side marginal portions, support means hingedly supporting the rear marginal portion of said cover from said rear marginal portion of said top unit for swinging about an axis generally paralleling said rear marginal portions between a closed position closely overlying said top unit from above and an open position extending upwardly from said rear marginal portion of said top unit, said top unit including outstanding front, rear and opposite side upwardly facing abutment surfaces spaced below the upper extremity of said top unit closely opposed by the front, rear and opposite side marginal portions of said downwardly opening cover when said cover is in the closed position, the portion of said top unit disposed above said abutment surfaces defining a forwardly opening drawer compartment, and a drawer slidably mounted in said compartment and maintained in closed position by said front marginal portion of said cover when said cover is in the closed position, the portions of said top unit disposed below said abutment surfaces defining forwardly opening drawer compartment means, and in the closed position, the portions of said top unit disposed below said abutment surfaces defining fowardly opening drawer compartment means, and drawer means slidably mounted in said compartment means, said drawer compartment means including a pair of forwardly opening laterally spaced apart lower drawer compartments spaced inwardly of said opposite side marginal portions of said top unit and a pair of lower drawers slidably mounted in said opposite side drawer compartments, said top unit defining a center front-to-rear extending downwardly opening cavity between said opposite side drawer compartments and a pair of opposite side front-to-rear extending downwardly opening cavities between remote sides of said lower drawer compartments and the adjacent side marginal portions of said top unit, a pair of collapsed side legs housed in said side compartments and a collapsed center leg housed in said center compartment, said legs being extendible and positionable in depending operative positions extending downwardly from their respective compartments for support of said top unit in an elevated position from upwardly facing surface portions from which the lower ends of said legs are supported, a bottom panel having a front, rear and opposite side marginal portions, means pivotally mounting said bottom panel rear marginal portions from a lower portion of said rear marginal portion of said top unit for swinging of said bottom panel about an axis generally paralleling said rear marginal portions between an open position depending downwardly from said top unit rear marginal portion and a closed position closely underlying said top unit from said below and closing said center and side compartments when said legs are collapsed therein.

8. The combination of claim 7 wherein said front marginal portion of said bottom panel includes front closure panel means hingedly supported therefrom and swingable after said bottom panel has been swung to the closed position thereof, into closed position closely opposing the forward extremities of said lower drawers and releasably latchable in closed position to prevent movement of said lower drawers from the closed positions thereof toward the open positions.

* * * * *